US007036556B2

(12) United States Patent
Caputo et al.

(10) Patent No.: US 7,036,556 B2
(45) Date of Patent: May 2, 2006

(54) INVESTMENT CASTING PINS

(75) Inventors: Michael F. Caputo, Beachwood, OH (US); Larry E. Shilling, Dover, OH (US)

(73) Assignees: Oroflex Pin Development LLC, Beachwood, OH (US); Shilling Industrial Technologies and Services, LTD, Dover, OH (US)

( * ) Notice: Subject to any disclaimer, the term of this patent is extended or adjusted under 35 U.S.C. 154(b) by 0 days.

(21) Appl. No.: 11/059,897

(22) Filed: Feb. 17, 2005

(65) Prior Publication Data

US 2005/0189086 A1 Sep. 1, 2005

Related U.S. Application Data

(60) Provisional application No. 60/548,548, filed on Feb. 27, 2004.

(51) Int. Cl.
*B22C 9/10* (2006.01)

(52) U.S. Cl. ..... 164/369; 164/361

(58) Field of Classification Search ..... 164/397, 164/398, 399, 369, 361
See application file for complete search history.

(56) References Cited

U.S. PATENT DOCUMENTS 3,125,787 A * 3/1964 Lirones et al. ..... 164/24
3,142,875 A * 8/1964 Lirones et al. ..... 164/32
3,957,104 A 5/1976 Terpay
4,487,246 A 12/1984 Frasier
4,986,333 A 1/1991 Gartland
5,245,132 A 9/1993 Luetzow
5,505,250 A 4/1996 Jago
5,623,985 A 4/1997 Wheaton et al.
6,119,761 A 9/2000 Anazawa et al.
6,244,327 B1 * 6/2001 Frasier ..... 164/34
6,255,000 B1 * 7/2001 O'Connor et al. ..... 428/586

* cited by examiner

*Primary Examiner*—Len Tran
(74) *Attorney, Agent, or Firm*—Sand & Sebolt

(57) ABSTRACT

A pin used in investment casting, or the lost wax process, to support the ceramic core of a mold includes a core formed of a metal which provides suitable strength to maintain the position of the ceramic core during pouring of molten metal into the mold but which is susceptible to oxidation during firing of the mold. The pin core is encased with an outer coating formed of a metal which resists oxidation during firing of the mold and resists chemical interaction during processing of the cast part. An intermediate coating is preferably disposed between the core and outer coating and is likewise formed of a metal which resists oxidation during firing of the mold and resists chemical interaction during processing of the cast part. The invention also includes an investment casting mold using a plurality of these pins and methods of making the pin and the mold.

24 Claims, 2 Drawing Sheets

INVESTMENT CASTING PINS

CROSS REFERENCE TO RELATED APPLICATIONS

This application claims priority from U.S. provisional application Ser. No. 60/548,548 filed Feb. 27, 2004; the disclosure of which is incorporated herein by reference.

BACKGROUND OF THE INVENTION

1. Technical Field

The invention relates to an improved pin for locating a core of a mold used in the investment casting or lost wax process. More particularly, the invention relates to such a pin having a wire center of one metal which is coated with another metal. Specifically, the invention relates to such a pin which resists oxidation during firing of the mold, supports the core of the mold during high-temperature casting and is metallurgically compatible with the casting metal or alloy.

2. Background Information

The investment casting process, or lost wax process, is used to produce hollow cast parts. The mold used to create these hollow parts involves the use of a ceramic core which must be supported by the investment casting pins to hold it in proper position as the remainder of the mold is formed and the final part is cast. The ceramic core is fixed within a wax pattern which is essentially in the form of the final part. The wax pattern is then encased by dipping the core and wax pattern in a ceramic slurry. After the slurry dries, the wax is melted out. The entire assembly is then fired at temperatures typically ranging from 1300 to 1900 degrees Fahrenheit, leaving the hardened ceramic core and shell with casting pins extending therebetween to form the mold for the final part. Thus, the core achieves a proper position within the shell with the aid of the casting pins. Molten metal is poured into the mold to form the cast metal part.

Most often, the mold is fired in an oxidizing environment, although a reducing atmosphere is also possible. Because it is most common to fire in an oxidizing environment, casting pins undergoing such a firing must be resistant to oxidation at these high temperatures. In addition, the pins must be of appropriate material so that no chemical interaction occurs between the pins and the ceramic shell or ceramic core. Casting of metal into the mold typically occurs in a relatively low-oxygen environment and so the concern of oxidizing the pins during casting is reduced. However, there may still be some concern of pin oxidation during casting depending on the specific environment.

During the casting process, it is important that the core of the mold does not shift within the shell. Otherwise, the final part will have walls which are too thick or too thin for the ultimate application. The aerospace and power generation industries, for example, require high-quality parts which must meet close tolerances to provide peak performance and, in many cases, prevent catastrophic failure in an aircraft or power generator. If the core shifts sufficiently so that the final part does not meet such tolerances, the part must be rejected. In order to ensure that the core does not shift or that it shifts only within acceptable tolerances, it is important that the casting pins be sufficiently strong at casting temperatures to sufficiently support the ceramic core. For directionally solidified or single crystal processes, the casting temperature may approach 3,000 degrees Fahrenheit, which limits the possible composition of casting pins for such applications.

In addition, to produce high-quality parts free of unacceptable inclusions, chemical reactions or voids which could negatively affect the strength of the final part, the casting pins must be compatible with the metal or alloy of the final part. The composition of the pin must also be chosen so that the pin completely dissolves into the final part, which is typically an alloy. Final parts are commonly formed of special nickel alloys.

Solid platinum casting pins have been used in high temperature castings. However, platinum has become very costly and also suffers from softening or sagging at casting temperatures, thus providing insufficient support for heavier ceramic cores. Therefore, other casting pins are needed which address the above-noted problems in the art.

BRIEF SUMMARY OF THE INVENTION

The present invention provides an apparatus comprising an investment casting pin including an elongated core formed of a metal which is susceptible to oxidation at a temperature associated with firing of a ceramic investment casting mold; and an outer coating which completely encases the elongated core and is formed of a metal capable of resisting chemical interaction with ceramic materials and oxidation at said temperature.

One embodiment also includes an intermediate coating which is disposed between the core and the outer coating and is formed of a metal capable of resisting chemical interaction with ceramic materials and oxidation at the temperature associated with firing of a ceramic investment casting mold.

Another embodiment further includes a ceramic shell and a ceramic core wherein a plurality of the pins extend from the ceramic shell to the ceramic core whereby the pins support the ceramic core within the ceramic shell.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numerals refer to similar parts throughout the specification.

DETAILED DESCRIPTION OF THE INVENTION

Figure 1:
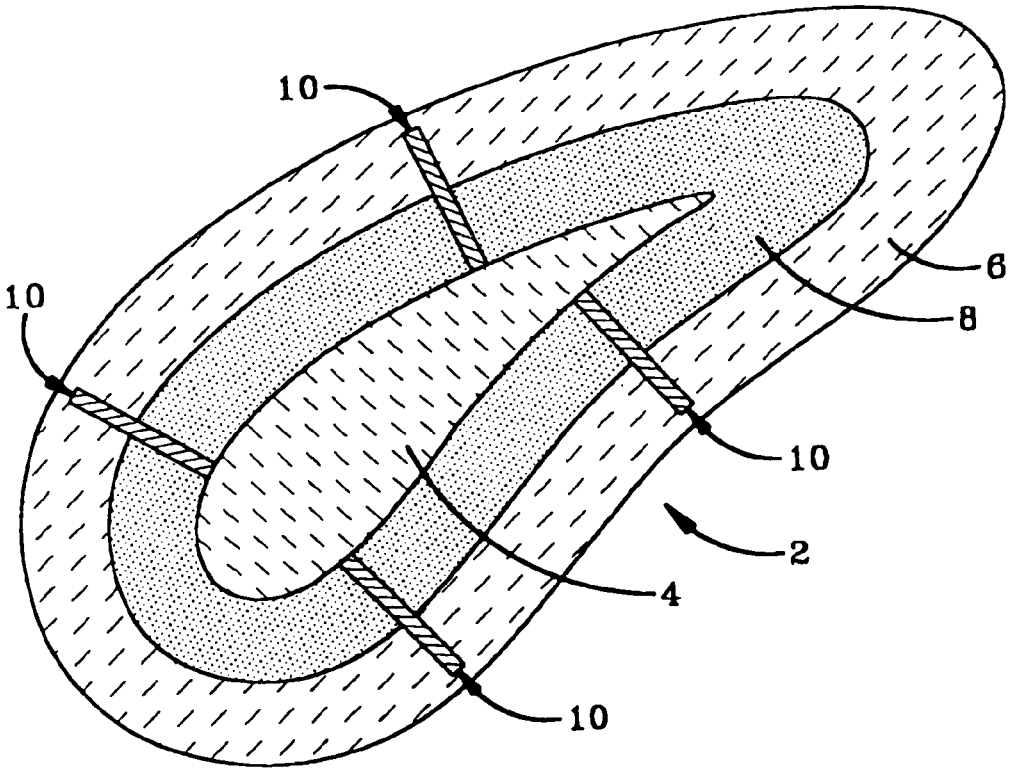
FIG. 1 is a sectional view of a mold in which the casting pins of the present invention are used to support the core of the mold within the shell of the mold.
Figure 2:
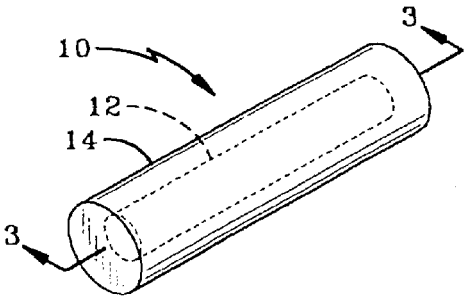
FIG. 2 is a perspective view of a first embodiment of the casting pin of the present invention.
Figure 3:
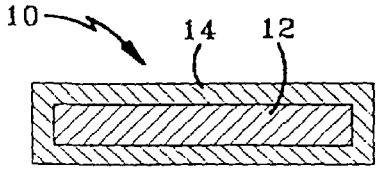
FIG. 3 is a sectional view taken on line 3—3 of FIG. 2.
Figure 4:
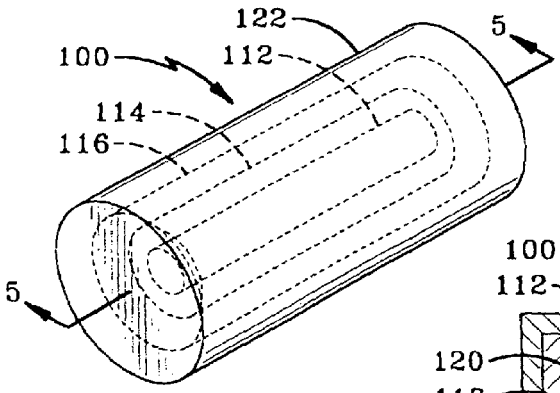
FIG. 4 is a perspective view of a second embodiment of the casting pin of the present invention.
Figure 5:
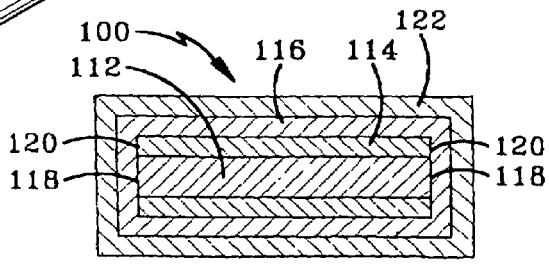
FIG. 5 is a sectional view taken on line 5—5 of FIG. 4.
Figure 6:
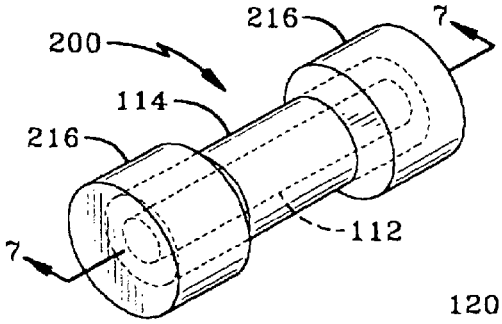
FIG. 6 is a perspective view of a third embodiment of the casting pin of the present invention.
Figure 7:
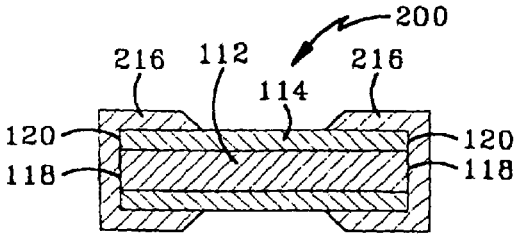
FIG. 7 is a sectional view taken on line 7—7 of FIG. 6.

A first embodiment of the casting pin of the present invention is indicated at 10 in FIGS. 2–3. A second embodiment of casting pin of the present invention is indicated at 100 in FIGS. 4–5. A third embodiment of the invention is shown at 200 in FIGS. 6–7. Casting pins 10, 100 and 200 are used in the investment casting process, or lost wax process, to cast hollow metal parts. Such casting pins, as at 10 in FIG. 1, are used with regard to a mold 2 to support a ceramic core 4 within a ceramic shell 6 which is formed around a wax pattern 8. Pins 10 extend from within shell 6 to a position closely adjacent or abutting core 4. Pins 10 may also extend into core 4 slightly, although this is not preferred.

Casting pin 10 (FIGS. 2–3) includes a core 12 formed of a metal which is susceptible to oxidation at sufficiently high temperatures and a protective coating 14 formed of a non-oxidizing metal or a metal which resists oxidation at said high temperatures. As noted in the Background section above, these temperatures may range from 1,300 to 1,900 degrees Fahrenheit and are typically from 1,500 to 1,700 degrees Fahrenheit. Core 12 is configured to provide sufficient strength during firing of mold 2 and during high-temperature casting of metal parts in order to maintain ceramic core 4 in proper position within ceramic shell 6 so that the thickness of the walls of the final part fall within acceptable tolerances. As also noted in the Background section, the casting temperature may approach 3,000 degrees Fahrenheit. The casting temperature is usually in the range of 2,500 to 3,300 degrees Fahrenheit. Especially where nickel or a nickel alloy is involved, the casting temperature is usually in the range of 2,650 to 3,100 degrees Fahrenheit with a preferred range of 2,800 to 3,000 degrees Fahrenheit. Protective coating 14 is configured to ensure that during firing of mold 2 in an oxidizing environment, core 12 of pin 10 is not oxidized and thereby weakened to the point where it cannot support ceramic core 4. Coating 14 is also selected to ensure that no chemical interaction occurs between ceramic shell 6 and pin 10 or between ceramic core 4 and pin 10 during firing of mold 2 and during the casting of metal parts. As noted in the Background section above, the concern of oxidizing casting pins during the casting process is generally reduced due to the typical relatively low-oxygen environment. However, pin 10 is configured to prevent oxidation during casting as well, as are pins 100 and 200.

Core 12 is typically a wire in the form of an alloy which retains substantial strength at high temperatures. The wire is a drawn wire which is cleaned and carefully straightened so that cracks or fissures are not formed in the wire. Preferably, the wire is straightened with warm rotary straighteners using fibrous or Teflon pads to avoid any damage or imperfections in the wire's surface. The wire is cut into the appropriate pin lengths with a double-cylindrical knife for each diameter required. Core 12 is then plated with a metal to produce coating 14, which entirely covers core 12 so that core 12 is not exposed to the oxidation environment during the firing of mold 2. Particularly for use with the high temperatures noted in the Background of this application, core 12 is preferably formed of molybdenum, tungsten or a molybdenum-tungsten alloy and coating 14 is preferably formed of nickel, cobalt, chromium, manganese, vanadium, gold, platinum, palladium, niobium, iridium, osmium, rhenium, rhodium, ruthenium or alloys thereof. Coating 14 is typically applied to core 12 by electroplating, but may also be achieved by other methods known in the art, such as vacuum metallizing, vapor deposition and slurry deposition.

Casting pin 100 (FIGS. 4–5) is similar to pin 10 except that pin 100 includes additional protective coatings, as further detailed below. Pin 100 includes a core 112 formed of a metal, an intermediate protective coating 114 formed of a metal different from that of core 112 and outer protective coating or oxidation barrier 116. Pin 100 optionally includes another protective coating 122. Core 112 has opposing ends 118 and coating 114 has opposed ends 120. More particularly, core 112 is clad by a thin layer or coating 114 during a wire drawing process. This process involves the insertion of a wire which will become core 112 into a tube which will become intermediate coating 114. The wire and tube are drawn out together to elongate and thin the two, thus forming a clad wire. The clad wire is then straightened and cut to form an interior portion of each pin 100 which includes core 112 and coating 114. Because ends 118 of core 112 are exposed during the formation of the interior portion of pin 100, outer coating 116 is needed to prevent oxidation of core 112 via exposed ends 118. Under certain circumstances, protective coating 122 may be used to provide additional protection against oxidation, in which case coating 122 is an outer coating, coating 114 is a first intermediate coating and coating 116 is a second intermediate coating.

Core 112 and coating 114 are thus plated with a metal to produce coating 116, which entirely covers the exposed portions of core 112 and intermediate coating 114 so that ends 118 of core 112 are not exposed to the oxidizing environment during the firing of a mold such as mold 2. In addition to providing a barrier against oxidation of core 112, coating 116 also fills in any cracks or gaps in the clad intermediate coating 114 and helps resist damage to pins 100 during handling, particularly during assembly of mold 2. For use with the high temperatures noted in the Background of this application, core 112 is preferably formed of molybdenum or tungsten. Coating 114 is formed from the materials noted above regarding coating 14 of pin 10 and is most preferably formed of platinum or nickel. Coating 116 is preferably formed from the materials noted above regarding coating 14 of pin 10. More preferably, coating 116 is formed of nickel, cobalt, chromium, manganese, vanadium or alloys thereof, especially nickel when used as a second intermediate coating. Optional outer coating 122 is preferably formed of gold, platinum, palladium, niobium, iridium, osmium, rhenium, rhodium, ruthenium or alloys thereof. More preferably, coating 122 is formed of gold, rhodium or an alloy thereof and most preferably of gold.

The first coating (here, outer coating 116) which covers ends 118 of core 112 (most typically by electroplating) has the beneficial property of providing, upon sufficient heating, a diffusion pathway for the highly desirable clad material of intermediate coating 114 to also cover ends 118 of core 112. Although sufficient heating could occur elsewhere, this process of end protection normally occurs during the mold fire cycle or early stages of casting and greatly enhances the protective nature of the intermediate coating. More particularly, at the elevated temperatures reached during firing of the mold, the metal of coating 114 diffuses into the metal of outer coating 116, allowing some of the metal of coating 114 to travel via coating 116 to cover, along with metal 116, ends 118 of core 112. Stated differently, during the firing of the mold, intermediate coating 114 and outer coating 116 form an alloy which covers ends 118, thus enhancing oxidation resistance with respect to ends 118.

Casting pin 200 (FIGS. 4–5) is similar to pin 100 except that pin 200 includes an outer protective coating 216 which is slightly different than outer coating 116 of pin 100. Coating 216 does not cover all the exposed portions of intermediate coating 114, but only the end portions thereof including ends 120 and also ends 118 of core 112. Thus, outer coating 216 primarily provides protection against the oxidation of core 112 via ends 118. Coating 216 does not provide the extent of additional barrier that coating 116 of pin 100 provides, as coating 216 leaves a central portion of intermediate coating 114 exposed. Coating 216 may cover only ends 120 without extending, for example, along the length of pin 200. Coating 216 is typically formed of the same materials as noted above regarding coating 116. Diffusion of intermediate coating 114 into outer coating 216 when sufficiently heated applies as described above with regard to pin 100.

It is noted that the thickness of coatings 14, 114, 116, 122 and 216 as shown in the drawings is generally exaggerated. The thickness of said coatings is typically quite minimal, as noted below. The investment casting pins of the present invention are generally formed of a wire drawn to a diameter ranging from 0.005 to 0.2 (5/1000 to 2/10) inch (including cladding when used), and cut to a length ranging from 0.005 (5/1000) to 1.0 (one) inch, then coated (most typically by electroplating) with a coating having a thickness ranging from 25 to 400 millionths of an inch (micro-inches), and if necessary, an additional coating (also typically electroplated) having a thickness ranging from 5 to 60 millionths of an inch. When the wire is clad, the cladding thickness is typically 0.0001 to 0.003 (1/10,000 to 3/1000) inch.

One preferred embodiment is a such a clad or coated wire with a diameter ranging from 0.005 to 0.075 (5/1000 to 75/1000) inch (including cladding when used), a length ranging from 0.050 to 0.750 (50/1000 to ¾) inch, a coating having a thickness ranging from 50 to 300 millionths of an inch, and if necessary, an additional coating having a thickness ranging from 5 to 40 millionths of an inch.

More preferably, such a wire has a diameter ranging from 0.012 to 0.050 (12/1000 to 50/1000) inch (including cladding when used), a length ranging from 0.080 to 0.500 (80/1000 to ½) inch, a coating having a thickness ranging from 50 to 300 millionths of an inch, and if necessary, an additional coating having a thickness ranging from 10 to 40 millionths of an inch.

Preferably, the wire is a platinum-clad molybdenum wire wherein the outer coating is nickel, and, if used, the additional coating is preferably gold, rhodium or an alloy thereof and most preferably gold.

The invention also includes an investment casting mold using pins 10, 100 or 200 and methods of making the same. More particularly, this involves forming a ceramic core, encasing the ceramic core with wax, inserting a plurality of pins 10, 100 or 200 through the wax to the ceramic core, forming a ceramic shell around the wax whereby the pins extend into the shell, removing the wax, and firing the ceramic core, ceramic shell and pins to form a mold whereby the ceramic shell supports the ceramic core via the pins. Molten metal is then poured into the cavity and the pins dissolve into the casting as it solidifies.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:

an investment casting pin including:

an elongated core formed of a metal which is susceptible to oxidation at a temperature associated with firing of a ceramic investment casting mold;

an outer coating which completely encases the elongated core and is formed of a metal capable of resisting chemical interaction with ceramic materials and oxidation at said temperature; and an intermediate coating which is disposed between the core and the outer coating and is formed of a metal capable of resisting chemical interaction with ceramic materials and oxidation at said temperature.

2. The apparatus of claim 1 wherein the core is formed from one of a group consisting of molybdenum, tungsten and a molybdenum-tungsten alloy.

3. The apparatus of claim 2 wherein the outer coating is formed from at least one of a group consisting of nickel, cobalt, chromium, manganese, vanadium, gold, platinum, palladium, niobium, iridium, osmium, rhenium, rhodium and ruthenium.

4. The apparatus of claim 3 wherein the core is clad with platinum to form the intermediate coating disposed between the core and the outer coating.

5. The apparatus of claim 1 wherein the core has a diameter ranging from 0.005 to 0.2 inch; and wherein the outer coating has a thickness ranging from 25 to 400 millionths of an inch.

6. The apparatus of claim 1 wherein the core has length ranging from 0.005 to 1.0 inch.

7. The apparatus of claim 1 wherein the core has a length ranging from 0.050 to 0.750 inch and a diameter ranging from 0.005 to 0.075 inch; and wherein the outer coating has a thickness ranging from 50 to 300 millionths of an inch.

8. The apparatus of claim 1 wherein the core has a length ranging from 0.080 to 0.500 inch and a diameter ranging from 0.012 to 0.050 inch; and wherein the outer coating has a thickness ranging from 50 to 300 millionths of an inch.

9. The apparatus of claim 1 wherein the temperature is in the range of 1300 to 1900 degrees Fahrenheit.

10. The apparatus of claim 1 wherein the metal of the outer coating is capable of resisting chemical interaction with ceramic materials at a temperature associated with casting metals in a ceramic investment casting mold.

11. The apparatus of claim 10 wherein the temperature associated with casting metals is in the range of 2,500 to 3,300 degrees Fahrenheit.

12. The apparatus claim 1 wherein the core has opposed ends and the intermediate coating encases the core except for the ends thereof.

13. The apparatus of claim 1 wherein each of the intermediate coating and the outer coating is formed from at least one of a group consisting of nickel, cobalt, chromium, manganese, vanadium, gold, platinum, palladium, niobium, iridium, osmium, rhenium, rhodium and ruthenium.

14. An apparatus comprising:

an investment casting pin including:

an elongated core formed of a metal which is susceptible to oxidation at a temperature associated with firing of a ceramic investment casting mold;

an outer coating which completely encases the elongated core and is formed of a metal capable of resisting chemical interaction with ceramic materials and oxidation at said temperature; and a ceramic shell and a ceramic core; and wherein a plurality of the pins extend from the ceramic shell to the ceramic core whereby the pins support the ceramic core within the ceramic shell.

15. The apparatus of claim 14 wherein the core of each pin is formed from one of a group consisting of molybdenum, tungsten and a molybdenum-tungsten alloy; and wherein the outer coating of each pin is formed from at least one of a group consisting of nickel, cobalt, chromium, manganese, vanadium, gold, platinum, palladium, niobium, iridium, osmium, rhenium, rhodium and ruthenium.

16. The apparatus of claim 14 wherein an intermediate coating is disposed between the core and the outer coating and is formed of a metal capable of resisting chemical interaction with ceramic materials and oxidation at said temperature.

17. The apparatus of claim 16 wherein the core of each pin is formed from one of a group consisting of molybdenum, tungsten and a molybdenum-tungsten alloy; and wherein each of the intermediate coating and the outer coating is formed from at least one of a group consisting of nickel, cobalt, chromium, manganese, vanadium, gold, platinum, palladium, niobium, iridium, osmium, rhenium, rhodium and ruthenium.

18. The apparatus of claim 14 wherein a plurality of the pins extend between a first portion of the ceramic shell and the ceramic core; wherein a plurality of the pins extend between a second portion of the ceramic shell and the ceramic core; and wherein the ceramic core is disposed between the first and second portions of the ceramic shell.

19. The apparatus of claim 14 wherein the pins are capable of supporting the ceramic core substantially without shifting of the ceramic core within the ceramic shell at a temperature in the range of 2,500 to 3,300 degrees Fahrenheit whereby the apparatus is adapted for casting a metal part between the ceramic shell and ceramic core so that thicknesses of walls of the cast metal part are within acceptable tolerances; and wherein the pins melt at said temperature whereby the pins are adapted to completely dissolve in the cast metal part.

20. The apparatus of claim 14 in combination with a cast metal part formed between the ceramic core and the ceramic shell; and wherein the pins are completely dissolved in the cast metal part.

21. The apparatus of claim 14 formed by a method comprising the steps of:

encasing the ceramic core with wax;

inserting the plurality of pins through the wax to contact the ceramic core with the pins;

forming the ceramic shell around the wax so that the pins extend into the shell;

removing the wax; and firing the ceramic core, the ceramic shell and the pins to form the investment casting mold wherein the ceramic shell supports the ceramic core via the pins.

22. The method of claim 21 further including the step of pouring molten metal into the mold to form a cast metal part to include the step of supporting the ceramic core with the pins substantially without shifting the ceramic core within the ceramic shell and the step of dissolving the pins completely whereby the pins become an integral portion of the cast metal part.

23. An apparatus comprising:

an investment casting pin including:

an elongated core formed of a metal which is susceptible to oxidation at a temperature associated with firing of a ceramic investment casting mold;

an outer coating which is formed of a metal capable of resisting chemical interaction with ceramic materials and oxidation at said temperature;

an intermediate coating which is disposed between the core and the outer coating and is formed of a metal capable of resisting chemical interaction with ceramic materials and oxidation at said temperature; and wherein one of the outer coating, the intermediate coating and a combination of the outer and intermediate coatings completely encases the elongated core.

24. The apparatus of claim 23 wherein one of the outer coating and the intermediate coating completely encases the elongated core.

* * * * *